US007422255B2

(12) United States Patent
Hess

(10) Patent No.: US 7,422,255 B2
(45) Date of Patent: Sep. 9, 2008

(54) SLING

(75) Inventor: Ruedi Hess, Tegerfelden (CH)

(73) Assignee: SUXHESS, Hess Board & Process Consulting (CH)

( * ) Notice: Subject to any disclaimer, the term of this patent is extended or adjusted under 35 U.S.C. 154(b) by 126 days.

(21) Appl. No.: 10/501,532

(22) PCT Filed: Jan. 17, 2003

(86) PCT No.: PCT/CH03/00028

§ 371 (c)(1),
(2), (4) Date: Dec. 30, 2004

(87) PCT Pub. No.: WO03/059462

PCT Pub. Date: Jul. 24, 2003

(65) Prior Publication Data

US 2005/0093317 A1 May 5, 2005

(30) Foreign Application Priority Data

Jan. 18, 2002 (CH) ..... 0083/02

(51) Int. Cl.
*B66C 1/18* (2006.01)

(52) U.S. Cl. ..... 294/74; 294/148; 24/17 B

(58) Field of Classification Search ..... 294/74, 294/149, 150, 156; 24/17 AP, 17 B, 481, 24/482, 38, 31 L, 31 B; 57/21, 201; 63/3, 63/11

See application file for complete search history.

(56) References Cited

U.S. PATENT DOCUMENTS 2,449,181 A * 9/1948 Smiley ..... 40/633
3,554,417 A * 1/1971 Yorty ..... 294/149
3,707,021 A 12/1972 Norrman
4,055,857 A 11/1977 Brucciani
4,083,521 A 4/1978 Greiner, II
4,396,091 A 8/1983 Anderson
4,843,807 A * 7/1989 von Danwitz ..... 57/201
5,238,278 A * 8/1993 Kamper ..... 294/74
5,651,572 A * 7/1997 St. Germain ..... 294/74
5,829,374 A 11/1998 Hede et al.
5,873,613 A 2/1999 Bliehall et al.

FOREIGN PATENT DOCUMENTS

DE 3040501 A 6/1982
EP 0281287 A 9/1988
EP 0967314 A 12/1999

* cited by examiner

*Primary Examiner*—Dean J Kramer
(74) *Attorney, Agent, or Firm*—Buchanan Ingersoll & Rooney PC

(57) ABSTRACT

A sling for fixing or carrying load includes a tubular tissue or a tube-like tissue or fabric having two ends, one of the ends being narrower than or approximately as large as, and the other end being larger than or approximately as large as, the remaining tubular tissue located between the two ends. The two ends form a junction point by inserting the narrower end into the larger end and providing the narrower end with at least one seam in the area of the junction point, whereby the junction point is thinner, shorter, or narrower at a predefined strength than in conventional overlapping ends. The sling may be used in skiing, mountain climbing, and in the area of work safety.

18 Claims, 3 Drawing Sheets

SLING

BACKGROUND OF THE INVENTION

1. Field of the Invention

The invention relates to a sling, as well as to applications of the same.

2. Description of the Related Art

Slings are woven from band fabrics or band tubes and are finished off and fabricated in such a way that an endless loop results. These slings have the disadvantage that they must exhibit a great thickening at the site of the seam in order to achieve the required standard strengths. The woven fabrics must also be constructed and woven with very high strengths to compensate for the sewing loss at the site of the seam. Likewise, a certain width or thickness of the band material must be woven with a certain type of bond, coupled with the strength of the materials used in weft and warp, in order to achieve the required strengths.

However, in the areas of sports, leisure, hobby, and occupational safety, in particular, the slings should exhibit extremely small cross-sections, the smallest possible thickenings at the site of the seam, as well as low weights.

According to U.S. Pat. No. 5,873,613, a mechanical element is known that is connected by means of a band sling with overlapping ends with a climbing rope. The disadvantage hereby is that the site of the seam for connecting the overlapping ends results in a loss of strength of 25-30%. In addition, the site of the seam also presents a substantial hindrance to the sliding in the stop element, which is also associated with increased wear.

According to U.S. Pat. No. 5,829,374, a specially sewn terminal connection on a rope is known, which exhibits particular properties for high terminal connection strength.

Furthermore, according to U.S. Pat. No. 4,396,091, a sling is known, which was attached to a safety belt or harness, which also exhibits self-regulating adjustability.

According to the U.S. Pat. No. 4,083,521 a mechanical element for use in climbing sports, which is connected to a sling or a rope sling, is known.

SUMMARY OF THE INVENTION

It is the objective of the present invention to propose a sling that exhibits only an insignificant thickening at the connection site, low weight, and high tensile strength.

According to the invention, this objective is met with a sling according to the present invention and with applications according to the present invention.

BRIEF DESCRIPTION OF THE DRAWINGS

The invention is explained below in greater detail by virtue of the drawing.

DETAILED DESCRIPTION

Figure 1:
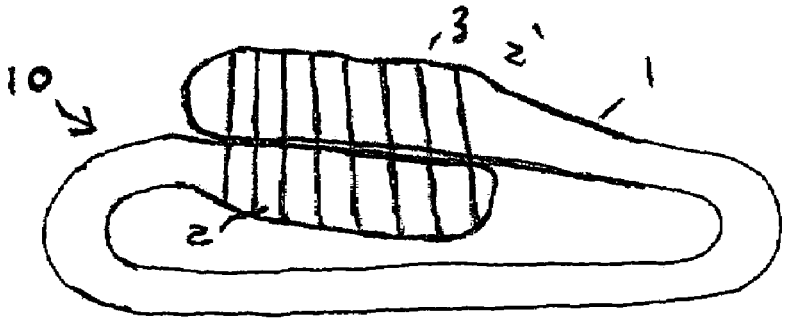
Fig. 1 PRIOR ART
FIG. 1 shows a view of a known sling.

FIG. 1 shows the view of a known sling. Sling 10 consists, for example, of a woven band 1 and exhibits ends 2, 2' that lie atop one another and are sewn without interruption. The resultant site of the seam 3 shows an undesired thickening, whose disadvantages have already been described.

Figure 2:
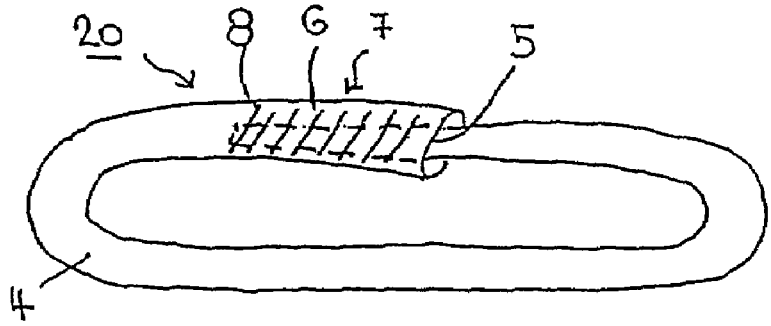
FIG. 2, the view of a sling according to the invention.

FIG. 2 shows the view of a sling according to the invention. A sling 20 consists of a tubular fabric 4 or a tube-like fabric or knit materials, respectively, with ends 5, 6, of which, one end, 5, is narrower or of approximately equal size and the other end, 6, is embodied so as to be broader or of approximately equal size relative to the rest of the tubular fabric, 4, which is found between the ends. End 5 can thus be inserted into the broader end 6, which is present in an expanded state, or be inserted into each other, 6, as a result of which a connection site 7 is formed in the area of which both ends are connected by at least one seam, 8.

The connection site 7 is now embodied so as to be thinner, shorter, or more narrow than is the case with overlapping ends of the customary sort. This sling exhibits a cross-section that is as small as possible in the ratio of thickness/width. It lends itself to the attachment or carrying of burdens of any arbitrary kind.

The sling is connected or suspended using means of attachment, such as spring hooks, hooks, eyelets, plastic parts, aluminum staves and steel tubes, or parts are extruded or molded on so that at these sites, a sling diameter or cross-section that is as slight as possible is extant.

The slings are woven, knitted, braided, or twisted so that they exhibit broader diameters at certain sites than at the other sites, and they are extant in the form of a loop. Both ends are then joined to a sling in endless form and are adjusted in diameter, or rather, cross-section, in such a way that the one end finds accommodation within the other end. The sewn joint, welded joint, or mechanical anchoring of the ends, which are inserted into each other, yields a much higher connective strength due to the doubled surface of the ends.

The slings are used as full slings in endless form. Slings of this nature are used as stopping slings for attaching systems that prevent falling, ropes, belts, fall dampers, or for the purpose of attaching to hooks, trees, supports, iron bars, and the like.

Figure 3:
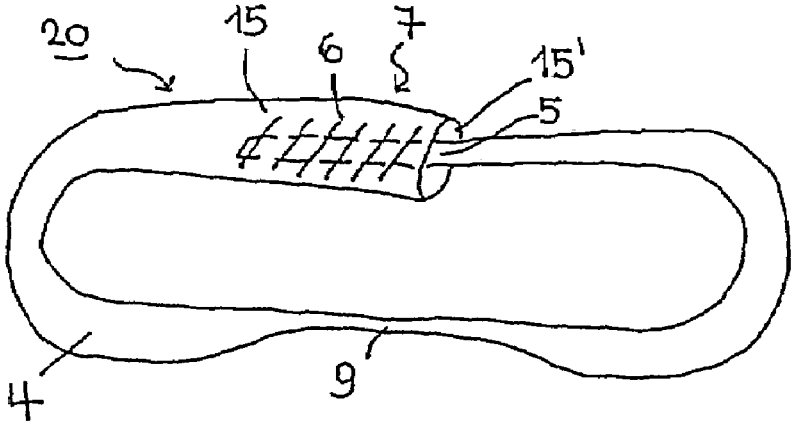
FIG. 3, a sling with narrow area.

FIG. 3 shows a sling with a narrow area. The connection site 7 is produced according to FIG. 2; it is embodied so as to be flat, and it exhibits a lower surface 15, 15'. Thus, the sling, on the upper and lower surface, 15, 15', exhibits a connection site 7 that is 50% thinner, with a slighter, smaller transition of the two ends 5, 6 than is the case with common, overlapping ends.

The connection site 7 of the two ends, 5, 6, which are inserted into each other, or joined, with their sewn joint of 2 woven fabrics each instead of one woven fabric each, exhibits a tensile strength that is substantially higher.

The ends 5, 6 are not necessarily produced of the same material. Thus, the selection of the material must, in large measure, be adapted to the purposes of the application. For example, one end 6 is a tube, and the other end 5, is an inelastic, semi-elastic, partially elastic, or elastic band, whereby the sewn joint of the ends exhibits a higher tensile strength and a slighter thickening of the connection site.

On the side of the sling 20 that lies opposite the connection site 7, there is a narrow site 9, or rather, a narrow area, for the introduction of a spring hook or the like, in a manner that is sparing of the material.

The tubular fabric 4 is embodied so as to be thinner and narrower at least one additional site relative to the remainder of the tubular fabric and it exhibits, as a result, at least one narrow area, or narrow site 9, respectively. The tubular fabric 4 can, furthermore, be embodied as a band at least one site, and as a cord at least one other site, whereby these sites can be arranged next to each other in rows in arbitrary sequence, and the ends may be adjoined in each case by means of insertion.

Figure 4:
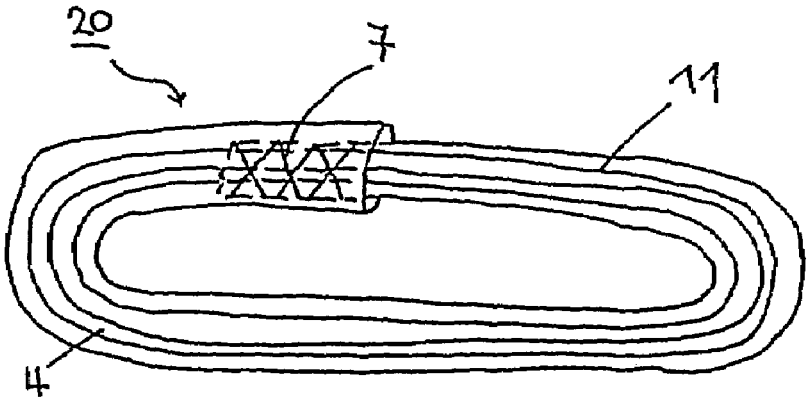
FIG. 4, a sling with drawstrings.

FIG. 4 shows a sling with drawstrings. The sling 20 exhibits a plurality of drawstrings 11 in the tubular fabric 4, which exhibit either an extremely high strength from materials such as polyester, Dyneema and aramide, or consist of an expandable material that has a fall-damping effect. The drawstrings 11 lie free within the tubular fabric 4, or are partially connected to the latter. At the connection site 7, they are sewn together with the surrounding tubular fabric. By these means, the tubular fabric serves as a protective mantle against sharp edges and/or cuts for the drawstrings.

The tubular fabric 4 is designed so as to be elastic and the drawstrings 11, to be inelastic, or the tubular fabric 4 is designed to be inelastic and the drawstrings 11, elastic.

The tubular fabric 4 is comprised of a combination of materials that differ in terms elasticity, behavior during expansion, resistance to cutting, resistance to tearing and resistance to abrasion, as a result of which an optimum of tensile strength, resistance to abrasion and cutting is achieved in conjunction with low weight. A combination of very strong fibers made of Dyneema, Kevlar, aramide, polyester, and polyamide may be considered for the tubular fabric 4.

Figure 5:
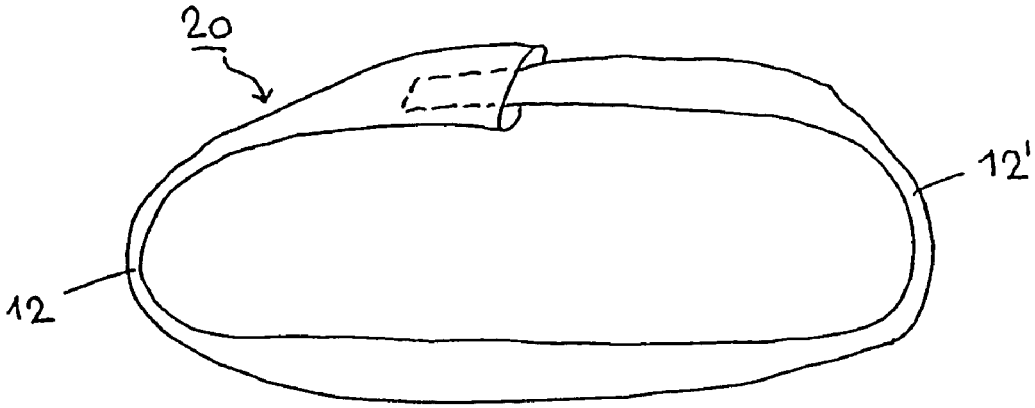
FIG. 5, a sling with a narrow cross-section for attachments.

FIG. 5 shows a sling with a narrow cross-section for attachments. The sling 20 exhibits a narrow cross-section on both sides 12, 12'. The attachments can be attachment parts, such as spring hooks, eyelets, steel clasps, iron supports or similar stopping parts or stopping elements.

Figure 6:
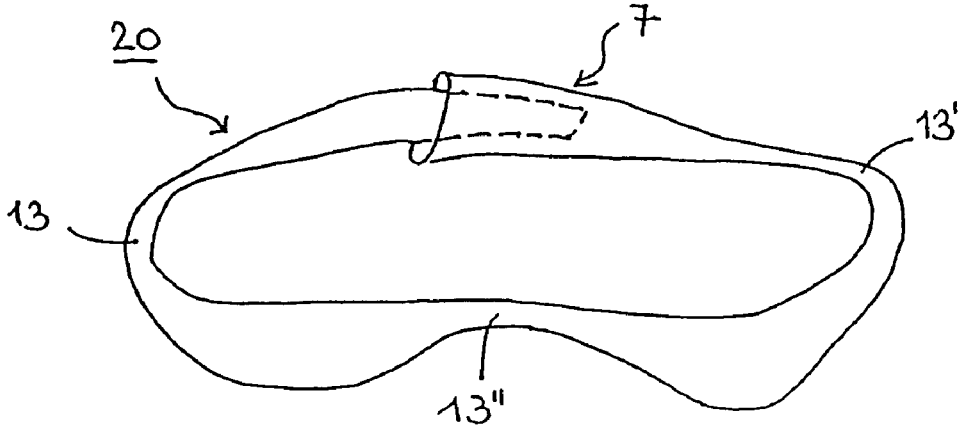
FIG. 6, a sling with a narrow cross-section and a broad cross-section at the connection site, FIG. 7, an embodiment of a sling with a narrow cross-section for hanging a spring hook and a broad cross-section in the area of the connection, FIG. 8, a second embodiment of a sling with an elastic part sewn in a highly sturdy manner, FIG. 9, a third embodiment of a sling with a narrow cross-section and a spring hook that has been hung on and a wide cross-section in the area of the connection with lock stitching, FIG. 10, a fourth embodiment example of a sling attached to a ski pole, with narrow parts and an elastic part sewn into the constituent area in a highly sturdy manner, and FIG. 11, a fifth embodiment of a sling with an elastic part as backpack belts.

FIG. 6 shows a sling with a narrow cross-section and a broad cross-section at the connection site. The sling 20 exhibits narrow cross-sections at three sites, 13, 13', 13," whereas the connection site 7 exhibits a broad cross-section. Above all, this sling is suitable for the application of spring hooks at three sites.

Figure 7:
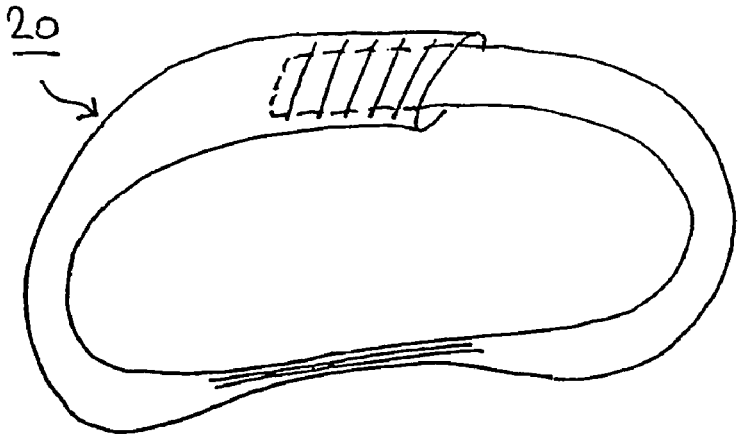

FIG. 7 shows an initial embodiment of a sling with a narrow cross-section (7 mm band) for attaching a spring hook and a broad cross-section (19 mm band, sewn on) in the connection area. The sling 20 consists of elastic or semi-elastic material, such as synthetic rubber or aramide, Dyneema, PEN [Polyethylene naphthalate] (polyester), which can be expanded across a certain distance and thereafter exhibits a high ultimate strength. The sling exhibits a length of 60 cm, and at an expansion of 20%, a length of 70-80 cm.

The length of the sling can vary between 20 cm and 3 m maximally, with correspondingly adjusted cross-sections.

Figure 8:
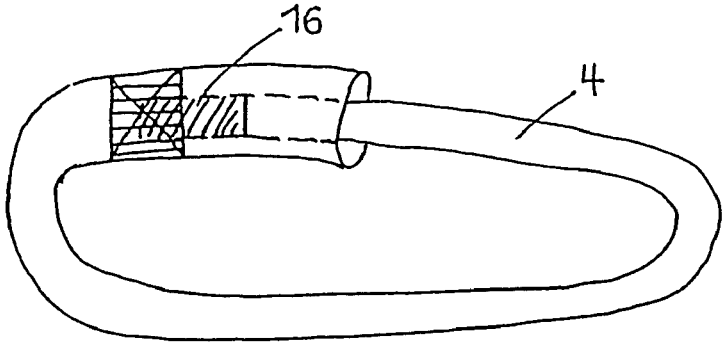

FIG. 8 shows a second embodiment of a sling, sewn together extremely solidly with elastic part 16. The tubular fabric 4 and the elastic part 16 exhibit identical warp threads. The elastic properties in part 16 result from the selection of a different weft material. Thus, in this part, a weave construction of a different nature, or a different knit is extant. The inserted elastic part 16 permits an elastic connection of the inserted element within the end of the tube.

This sling lends itself particularly well for a connection to means of stopping or to climbing sport equipment, such as ice axes.

Figure 9:
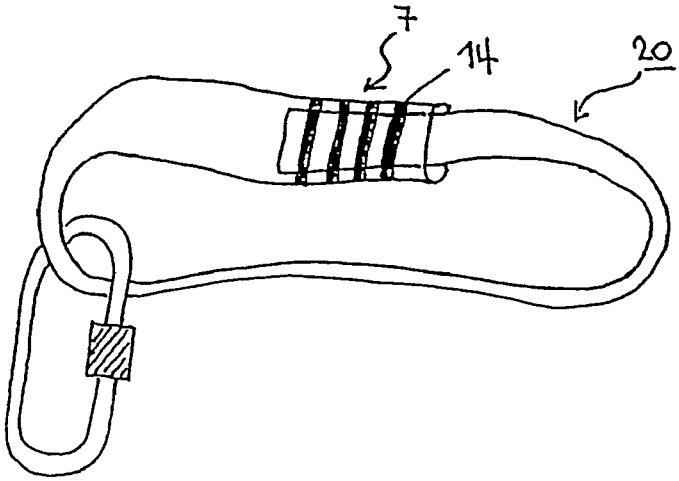

FIG. 9 shows a third embodiment of a sling with a narrow cross-section and attached spring hook and a broad cross-section in the connection area with a lock stitching. At connection site 7, sling 20 exhibits lock stitching 14, which represents just one of the many types of connection that assures high strength with little thickening at the connection site.

Figure 10:
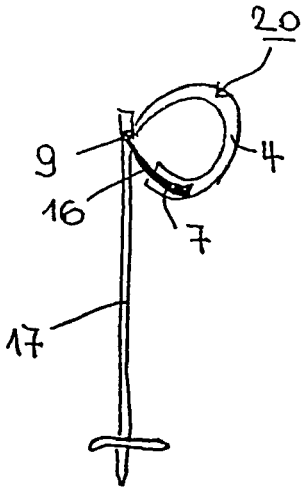

FIG. 10 shows a fourth embodiment of a sling, attached to a ski pole, with narrow parts and an elastic part very strongly sewn together in the constituent area. The sling 20 with tubular fabric 4, the elastic part 16 and the connection site 7 exhibits a narrow area 9 at which a ski pole 17 is attached. The tubular fabric 4 is embodied broadly and serves as a hand-rest, as usual. This yields an elastic effect, whereby shocks are dampened or the size of the sling, under tension, is enlarged.

Such partially elastic, semi-elastic slings are also used in ski and snowboard bindings.

Figure 11:
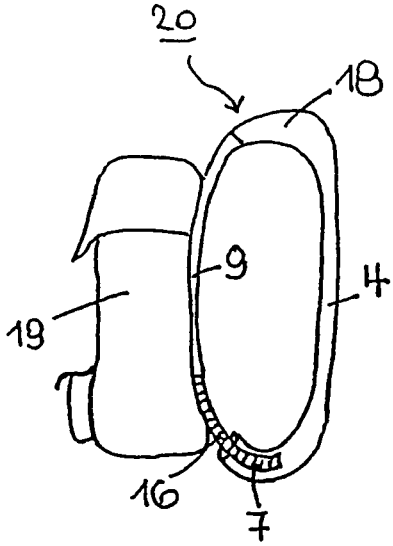

FIG. 11 shows a fifth embodiment of a sling with an elastic part as knapsack belts. Sling 20, with tubular fabric 4, the elastic part 16 and the connection site 7 exhibits a broad area 18, which serves as a point at which the shoulder rests. The tubular fabric 4 is connected by way of a narrow area 9 to the back portion of a knapsack 19. This sling permits a load-dampening effect with high strength.

The invention claimed is:

1. A sling for attaching or carrying loads, comprising:

a hollow tube like fabric comprising two ends, one end being formed narrower and the other end being formed broader relative to the rest of the hollow tube like fabric, which is found between the ends, wherein the two ends form a connection site wherein the narrower end is inserted into the broader end, and at least one seam, which connects both ends of the hollow tube like fabric at the connection site.

2. A sling according to claim 1, wherein the two ends form the connection site with a thickness that is 50% thinner, and with a smaller transition of the two ends than if the two ends were overlapped and sewn together.

3. A sling according to claim 1, wherein at the connection site the two ends are sewn together.

4. A sling according to claim 1, wherein at the connection site, the one end is a tube and the other end is an inelastic, a partially elastic, or an elastic band, and the two ends are sewn together.

5. A sling according to claim 1, wherein the hollow tube like fabric, at least one other site, comprises a cross-section that is narrower relative to the remaining hollow tube like fabric.

6. A sling according to claim 5, wherein the hollow tube like fabric, in the narrow cross-section, comprises a cord.

7. A sling according to claim 1, wherein the hollow tube like fabric comprises at least one site a band and at least one site a cord and the sites are aligned in random sequence next to each other and the ends are connected by insertion.

8. A sling according to claim 1, wherein the hollow tube like fabric comprises drawstrings that lie freely within the hollow tube like fabric.

9. A sling according to claim 8, wherein the hollow tube like fabric is elastic and the drawstrings are inelastic, or wherein the hollow tube like fabric is inelastic and the drawstrings are elastic.

10. A sling according to claim 1, wherein the hollow tube like fabric is comprised of a combination of materials that are distinct with respect to elasticity, expansion behavior, resistance to being cut, resistance to tearing and resistance to abrasion.

11. A sling according to claim 1, wherein the hollow tube like fabric is comprised of a combination of fibers of Dyeema, Kevlar, aramide, polyester and polyamide.

12. A sling according to claim 1 configured for use in the sport of climbing.

13. A sling according to claim 1 configured for use as a climbing sling or a stopping sling in the area of occupational safety.

14. A sling according to claim 1 configured for use with a ski pole or for a ski and snowboard binding.

15. A sling according to claim 1 configured for use as a knapsack support belt.

16. The sling according to claim 1, wherein the connection site, for a prescribed strength, is thinner, shorter or narrower than if the two ends were overlapped and sewn together.

17. A sling for attaching or carrying loads, consisting of:

a tube like fabric consisting of two ends, one end being formed narrower and the other end being formed broader relative to the rest of the tube like fabric, which is found between the ends, wherein the two ends form a connection site wherein the narrower end is inserted into the broader end, and a seam, which connects both ends at the connection site.

18. The sling according to claim 17, wherein the connection site, for a prescribed strength, is thinner, shorter or narrower than if the two ends were overlapped and sewn together.

* * * * *